United States Patent [19]

Jahnke et al.

[11] 3,961,992

[45] June 8, 1976

[54] METHOD OF TREATING METAL SURFACES

[75] Inventors: Richard William Jahnke, Mentor-On-The-Lake; Russell Lee Swaney, Mentor, both of Ohio

[73] Assignee: The Lubrizol Corporation, Cleveland, Ohio

[22] Filed: Oct. 3, 1974

[21] Appl. No.: 511,546

[52] U.S. Cl. ..... 148/6.15 R; 148/6.15 Z; 148/31.5; 428/460; 134/2

[51] Int. Cl.[2] ..... C23F 11/00; C23F 7/08

[58] Field of Search ..... 148/6.15, 6.15 R, 6.15 Z, 148/31.5; 117/127, 62, 50, 132 BF; 134/2; 428/460

[56] References Cited

UNITED STATES PATENTS

| | | | |
|---|---|---|---|
| 2,705,704 | 4/1955 | Sorenson | 117/132 BF |
| 2,834,745 | 5/1958 | Weber et al. | 117/132 BF |
| 3,288,745 | 11/1966 | Hempel et al. | 117/132 BF |
| 3,519,495 | 7/1970 | Plaxton | 148/6.16 |
| 3,697,331 | 10/1972 | Shatz et al. | 148/6.15 R |
| 3,707,401 | 12/1972 | Jarema et al. | 117/132 BF |
| 3,749,611 | 7/1973 | Leon et al. | 148/6.15 R |
| 3,776,782 | 12/1973 | Kiefer et al. | 148/6.15 R |
| 3,868,276 | 2/1975 | Shatz et al. | 148/6.15 R |

*Primary Examiner*—Michael F. Esposito
*Attorney, Agent, or Firm*—James W. Adams, Jr.; William H. Pittman

[57] ABSTRACT

Metal surfaces are treated, preferably after phosphating, with a phenol-formaldehyde composition or the like prepared under alkaline conditions, the mole ratio of formaldehyde to phenol being at least about 2:1. The phenol-formaldehyde composition is most often used as an aqueous solution. The treatment is a suitable substitute for the conventional chromate rinse.

12 Claims, No Drawings

METHOD OF TREATING METAL SURFACES

This invention relates to methods of treating metal surfaces and compositions for use therein. More particularly, it relates to a method of treating a metal article which comprises contacting the surface of said article with a composition prepared by reacting a hydroxyaromatic compound with formaldehyde under alkaline conditions, the mole ratio of said formaldehyde to said hydroxyaromatic compound being at least about 2:1.

It has been the practice for many years to form conversion coatings on metal surfaces by treatment with aqueous solutions of various chemicals. These chemicals react with the metal surface to form a coating which protects the metal against corrosion and also serves as a paint base. The most commonly used conversion coating compositions are phosphate and chromate solutions and many of these are known in the art. Frequently, a phosphate conversion coating is formed on the metal surface and is subsequently treated with a chromate solution as a post-rinse, which improves the corrosion resistance and paint adhesion of the coated metal.

Recent emphasis on water pollution problems has drawn attention to the fact that chromate-containing effluents are serious pollutants. To meet water-quality standards, it is frequently necessary to go through a multistage purification sequence in order to remove chromates from the process effluent. Typical steps in this sequence include reduction of the hexavalent chromium to trivalent chromium and precipitation with lime or some similar chemical. The result is that the chromium content of the effluent water is substantially decreased, but the expense of the treatment sequence to the user is quite high.

To alleviate this problem, interest has recently turned to the development of methods for metal treatment which do not involve the use of chromium chemicals. Of particular interest are methods involving biodegradable chemicals; that is, chemicals which decompose fairly rapidly after disposal and which thus do not permanently pollute natural waterways and the like. Few methods of this type have come into substantial use, however, since most of those developed do not give the desired level of protection of the metal surface.

A principal object of the present invention, therefore, is to develop new methods for treatment of metal surfaces to increase corrosion resistance and paint adhesion.

A further object is to provide such a method which involves the use of biodegradable chemicals.

A further object is to provide a metal surface treatment system which can be used as a post-rinse following the deposition of a phosphate coating on the metal.

Another object is to provide a chromium-free metal treatment system.

Still another object is to develop a system for metal treatment which will not result in substantial water pollution.

A still further object is to provide metal articles having improved surface properties.

Other objects will in part be obvious and will in part appear hereinafter.

As previously noted, the composition used in the method of this invention is prepared by reacting a hydroxyaromatic compound with formaldehyde. (The singular forms "A ", "an" and "the" as used herein include the plural unless the context clearly dictates otherwise; thus, for example, "a hydroxyaromatic compound" includes a mixture of such compounds.) Suitable hydroxyaromatic compounds include monohydroxy compounds such as phenol, the cresols, higher alkyl phenols, $\alpha$-naphthol and $\beta$-naphtol; dihydroxy compounds such as catechol, resorcinol and hydroquinone; and the like. Phenol and the cresols are especially useful, phenol is preferred because of its availability and relatively low cost. When reference is made to phenol hereinafter, it should be understood that other hydroxyaromatic compounds may be sustituted therefor when appropriate.

Formaldehyde may be employed in the form of a solution thereof, typically in water or in an alcohol such as methanol. Alternatively, a reversible polymer of formaldehyde, such as trioxane or paraformaldehyde, may be used.

For the preparation of the composition used in the method of this invention, the formaldehyde and phenol are reacted in a mole ratio of at least about 2:1. Most often, the mole ratio is between about 2.5:1 and about 4:1; ratios higher than 4:1, while within the scope of the invention, generally serve no purpose.

The reaction is ordinarily carried out in a substantially inert liquid diluent; by "substantially inert" is meant one which does not interfere with the reaction in any significant manner or itself undergo any appreciable reaction under the reaction conditions. The diluent is usually a polar liquid. Suitable polar liquids will be apparent to those skilled in the art and include water; lower alkanols such as methanol, ethanol, 1-propanol, isopropanol and the like; ether alcohols such as ethylene glycol monomethyl ether, diethylene glycol monomethyl ether and the like; etc. Mixtures of water and lower alkanols, especially methanol, are preferred since the compositions prepared therein have been found to have high storage stability.

The reaction between the phenol and formaldehyde is carried out under alkaline conditions, usually at a pH of about 7–11 and in the presence of an inorganic base such as sodium hydroxide, potassium hydroxide or an organic base such as a quaternary ammonium hydroxide. Inorganic bases are preferred. The amount of base used during the reaction is generally 0.05–0.3 equivalent per mole of phenol in the case of a strong base, or an amount of base to give a pH within the 7–11 range. A product of high storage stability is usually best prepared by adding the phenol in increments. For example, the formaldehyde may first be reacted with half the phenol in the presence of base, and the remainder of the phenol may subsequently be added. The reaction temperature is usually about 75°–125°C., preferably about 80°–100°C. After the reaction is complete, it is usually preferred to add enough base to increase the alkali content of the product to about 0.5–3.0 equivalents per mole of phenol.

The product obtained by the above-described method is ordinarily a solution of the phenol-formaldehyde condensate in the diluent. This solution is storage stable and is the concentrate which may be diluted for use in the method of this invention.

The preparation of a composition suitable for use in the method of this invention is illustrated by a procedure in which 877 parts by weight (16.08 moles of formaldehyde) of Methyl Formcel (a solution comprising 55% formaldehyde, 10% water and 35% methanol) and 265 parts (2.68 moles) of 95% assay phenol is mixed and 50 parts of a 31% methanolic solution of potassium hydroxide (0.28 mole of potassium hydroxide) is added, followed by 11.5 parts of methanol. The mixture is heated to 80°C., whereupon an exothermic reaction occurs and the temperature rises to 92°C. Heating and stirring are continued for one hour at 88°–92°C. The mixture is then cooled to 71°C. and an additional 265 parts (2.68 moles) of phenol is added. The mixture is again heated at 80°–88°C. for 45 minutes and then cooled to 40°C. An additional 931 parts (5.14 moles) of methanolic potassium hydroxide solution is added over one hour and the mixture is stirred, yielding the desired solution.

The method of this invention may be used for treating any metal, especially ferrous metals, galvanized ferrous metals and aluminum, with steel and galvanized steel being preferred. In general, the use of solutions containing about 0.1–0.5% by weight of the phenol-formaldehyde product is contemplated and such solutions are usually prepared by merely diluting the concentrate with water. The pH of the metal treatment solution is within the alkaline range (i.e., above 7), preferably above 8 and typically about 8–10.

In the metal treatment operation in which the method of this invention is used, the surface of the metal article is usually first cleaned by chemical and/or physical means to remove any grease, dirt and oxides. A phosphate conversion coating is then preferably deposited thereon. The phosphate coating may be any of the known types such as iron phosphate, zinc phosphate, manganese phosphate, calcium- and/or magnesium-modified zinc phosphate, etc., and its application is accomplished by any of the methods known to those skilled in the art.

Following the phosphating treatment, the metal object is usually rinsed again and is then treated with the phenol-formaldehyde solution. Said solution is usually applied at a temperature of about 0°–80°C. and preferably at about 25°–50°C. Application to the metal surface, or to any portion thereof for which treatment is desired, may be by any of the usual techniques, such as brushing, dipping, spraying, roller-coating and the like. The metal surface may be subsequently rinsed again with water if desired; such rinsing is preferred if electrodeposition of paint is contemplated. The surface is then dried by conventional means, usually by air-drying at ambient temperature and/or heating to a temperature high enough to remove volatile materials (including water and alcohol used as solvent). Temperatures of about 150°–200°C. are preferred during at least part of the drying operation. It is believed that the phenol-formaldehyde composition on the metal surface cures when dried to form a very thin resin coating.

After a metal article has been treated in accordance with the above-described method, it is preferred to apply an organic coating composition which may be a siccative coating such as paint, lacquer, varnish, synthetic resin, enamel or the like (which are preferred), an electrostatically deposited powder coating, or any other suitable type. Examples of siccative coatings which may be used are the acrylic, alkyd, epoxy, phenolic, melamine and polyvinyl alcohol resins and paints.

Application of a siccative coating composition can be effected by any of the ordinary techniques such as brushing, spraying, dipping, roller-coating, flow-coating, electrostatic or electrophoretic attraction, etc. The coated article is dried in the manner best suited for the siccative coating composition employed, e.g., by air-drying at ambient or elevated temperature, baking in an oven, or baking under infra-red lamps. In most instances the thickness of the dried film of ths siccative organic coating composition will be about 0.1–10.0 mils, preferably about 0.3–5.0 mils.

The effectiveness of the method of this invention is illustrated by a series of tests in which cold-rolled steel and galvanized panels are cleaned, treated with a titanium phosphate conditioner at 43°C., phosphated at about 50°C. by spray application of a commercial zinc phosphate solution containing magnesium, nickel, fluosilicate, chloride and nitrite ions, rinsed with water at room temperature, and then sprayed at 32°C., in accordance with the method of this invention, with an aqueous solution of a phenol-formaldehyde condensate prepared as described hereinabove. Some of the panels were subsequently rinsed with deionized water and dried at 177°C. for 5 minutes; the remaining panels were dried immediately without a water rinse.

The panels thus treated were painted with a white alkyd-melamine baking enamel. The paint film on each panel was ruptured down to the bare metal by scoring a 6-inch line on the surface of the panel. The scored panels were placed in a cabinet containing a 5% aqueous sodium chloride solution at 35°C. Air was bubbled through the solution to produce a corrosive salt atmosphere which acted on the surface of the test panels, suspended above the level of the salt solution. The panels remained in this atmosphere for 120 hours after which they were removed, washed with water and dried with a cloth. A pressuresensitive tape was then applied to each panel and removed suddenly. This procedure was repeated until no more paint could be removed in this manner. The loss of adhesion caused by corrosion from the scribed line was measured in 30-seconds of an inch (that is, in multiples of 0.8 mm).

The results of this test are given in the following table. The "control" consists of panels in whose treatment the rinse with the phenol-formaldehyde condensate was replaced by an ambient temperature rinse with a dilute nitric acid solution of pH 3.5.

| Condensate Concentration | Water Post-Rinse | Loss of Adhesion, Multiples of 1/32 in. (0.8 mm) Steel | Galvanized |
|---|---|---|---|
| Control | No | 9.0 | 1.0–1.5 |
| Control | Yes | 8.0 | 4.0 |
| 0.25% | No | 0–1.5 | 0 |
| 0.25% | Yes | 0.5–2.0 | 0 |
| 0.35% | No | 0–1.5 | 0 |
| 0.35% | Yes | 0.5–2.0 | 0 |

In addition to providing improved corrosion resistance and paint adhesion to metal surfaces, the phenol-formaldehyde condensates used in the method of this invention are biodegradable.

What is claimed is:

1. A method of rinsing a phosphated metal article which comprises contacting the surface of said phosphated article with a dilute solution consisting essentially of a solvent and the product obtained by reacting a hydroxyaromatic compound with formaldehyde under alkaline conditions, the mole ratio of said formaldehyde to said hydroxyaromatic compound being at least about 2:1.

2. A method according to claim 1 wherein the metal article is a steel or galvanized steel article.

3. A method according to claim 2 wherein the solvent is a mixture of water and a lower alkanol.

4. A method according to claim 3 wherein the hydroxyaromatic compound is phenol.

5. A method according to claim 4 wherein the metal article is a steel article and the lower alkanol is methanol.

6. A method according to claim 5 wherein the article is rinsed with water after treatment with said solution.

7. A method according to claim 4 wherein the metal article is a galvanized steel article and the lower alkanol is methanol.

8. A method according to claim 7 wherein the article is rinsed with water after treatment with said solution.

9. A metal article which has been treated according to the method of claim 1.

10. A metal article which has been treated according to the method of claim 4.

11. A metal article which has been treated according to the method of claim 5.

12. A metal article which has been treated according to the method of claim 7.

* * * * *